United States Patent [19]

Khan

[11] Patent Number: 4,495,673

[45] Date of Patent: Jan. 29, 1985

[54] DOUBLE-ACTING REFRIGERATOR DOOR HINGE WITH DUAL LATCH MEMBERS

[75] Inventor: Aman U. Khan, Lincoln Township, Berrien County, Mich.

[73] Assignee: Whirlpool Corporation, Benton Harbor, Mich.

[21] Appl. No.: 427,114

[22] Filed: Sep. 29, 1982

[51] Int. Cl.[3] ..... E05D 15/50

[52] U.S. Cl. ..... 16/232; 16/366; 16/380; 16/DIG. 23; 292/78; 292/207

[58] Field of Search ..... 16/230, 231, 232, 233, 16/257, 258, 259, 260, 263, 267, 268, 269, 270, 321, 323, 324, 325, 326, 327, 333, 335, 343, 345, 346, 347, 348, 349, 352, 357, 360, 366, 380, DIG. 32, DIG. 23; 292/216, 207, 78, 79; 49/382, 193

[56] References Cited

U.S. PATENT DOCUMENTS

| | | |
|---|---|---|
| 321,266 | 6/1885 | Whitney . |
| 418,255 | 12/1889 | Welter . |
| 2,711,803 | 6/1955 | Hurst . |
| 2,886,375 | 5/1959 | Crawford . |
| 3,020,084 | 2/1962 | Sylvester . |
| 3,290,719 | 12/1966 | Courson . |
| 3,889,419 | 6/1975 | Maleck . |
| 4,222,149 | 9/1980 | Holbek . |

FOREIGN PATENT DOCUMENTS

| | | |
|---|---|---|
| 100160 | 10/1964 | Denmark . |

*Primary Examiner*—Fred A. Silverberg
*Attorney, Agent, or Firm*—Wood, Dalton, Phillips, Mason & Rowe

[57] ABSTRACT

Structure for mounting a door to a cabinet for selective opening of the door from either side of an access opening provided in the cabinet. The door mounting structure includes hub portions which are removably associated with the hinge pins mounted on the cabinet. Positive locking structure is provided for positively maintaining the hub structures associated with the hinge pins about which the door is swung to prevent complete separation of the door from the cabinet. The positive locking structure includes a rigid element which is urged into interfering relationship with the hub structure associated with the cabinet hinge pin about which the door is being swung to prevent repositioning of that hub structure from a closed pin-engaging disposition to an open disposition wherein the pin is released. Overcenter detent structure is provided for maintaining the separable portions of the hub structure selectively in the opened and closed positions.

9 Claims, 5 Drawing Figures

FIG. 1
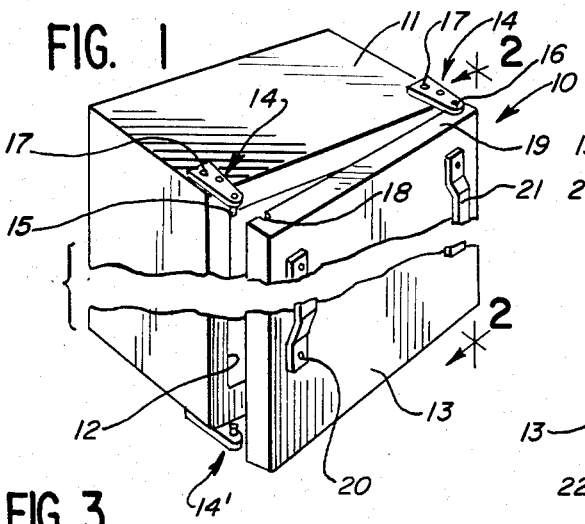
FIG. 2
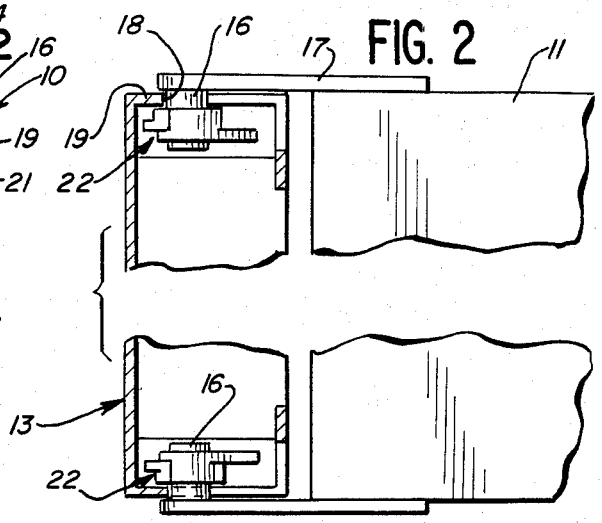
FIG. 3
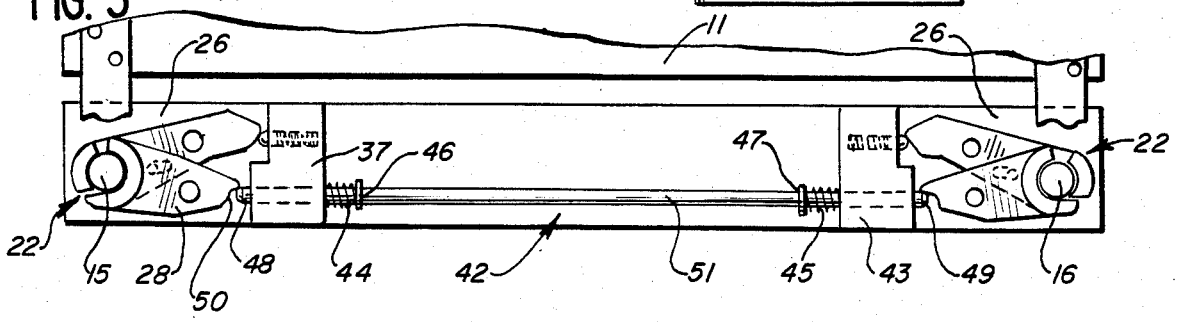
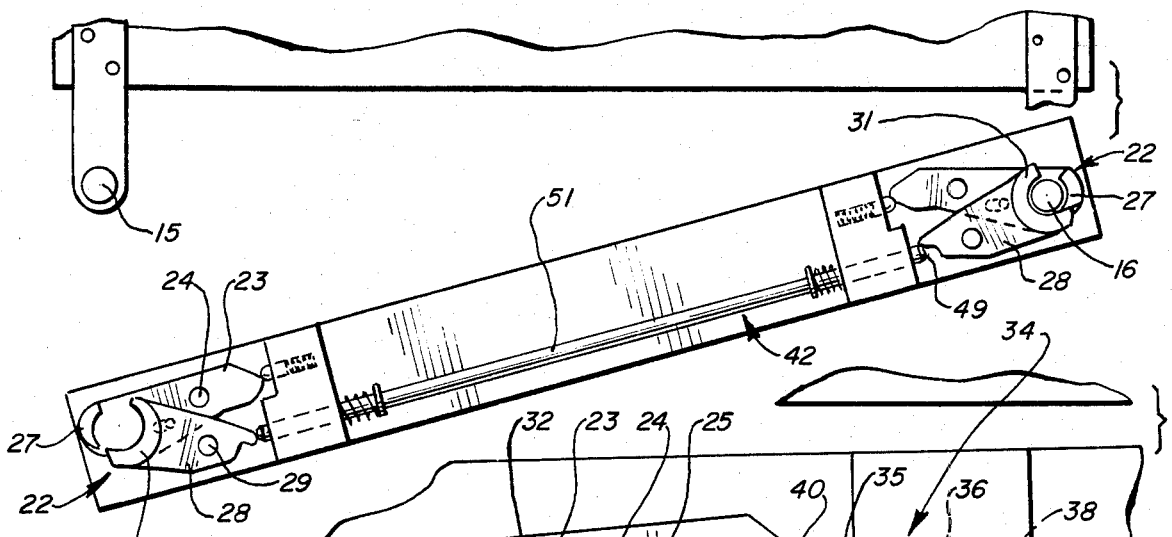
FIG. 4
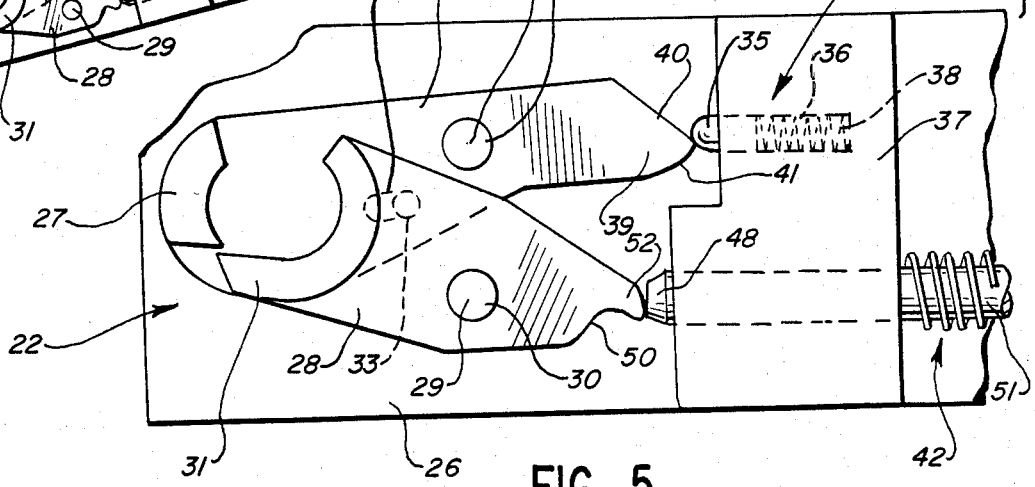
FIG. 5

DOUBLE-ACTING REFRIGERATOR DOOR HINGE WITH DUAL LATCH MEMBERS

BACKGROUND OF THE INVENTION

1. Field of the Invention

This invention relates to enclosures having a door arranged to be opened from either side of an access opening.

2. Description of the Prior Art

In refrigerators and the like, it is desirable to provide the access doors thereof to open from either the left or right side of the cabinet. One example of such a refrigerator enclosure structure is illustrated in U.S. Pat. No. 3,889,419 of Leroy Maleck. As shown therein, the cabinet is provided with a hinge pin disposed in each corner of the access opening and the door is provided with a pair of bolt assemblies, each having a bolt member which is slidable into entrapping engagement with the hinge pin for the purpose of forming a hinge mounting adjacent either the left or right-hand side of the door. The door includes a pair of handles on the right and left sides thereof. Each handle engages the bolt assemblies and can be moved to shift the bolts to form the hinge assembly on the side opposite to the handle that is being actuated.

Daniel W. Crawford discloses, in U.S. Pat. No. 2,886,375, a detachable top for a pickup truck wherein an actuating lever is provided for releasing the locking structure so as to permit the detachable top to be swung upwardly from either side of the truck body. A hook is associated with the latch mechanism, including a cam portion and a set portion and effects a latching operation by an overcenter movement.

Paul W. Sylvester shows, in U.S. Pat. No. 3,020,084, a swivel joint for a two-way tailgate mechanism in a pickup truck, having a pair of manually actuated movable jaw members cooperatively retaining a pivotally movable portion of the tailgate assembly.

In Danish Pat. No. 100,160 of H. F. O. Christensen, a door mounting mechanism is shown having a rigid interconnecting rod which is axially moved by the opening movement of one latch member so as to maintain the other latch member in latched association with the door hinge pin.

SUMMARY OF THE INVENTION

The invention comprehends the provision of an improved means for mounting a door to the opposite sides of an access opening provided in a cabinet so that the door may be opened from either side as desired by the user.

It is a primary object of the invention to provide a double-acting hinge mechanism which captures a hinge pin in a positive, close-fitting manner, whereby the hinge mechanism is particularly suited for use with doors which are relatively large and heavy, such as refrigerator doors. It is also an object of the invention to provide such a hinge mechanism wherein the hinge pin associated with the opposite side of the door from that which has been opened is positively retained against accidental disengagement from its associated hinge mechanism, so as to effectively prevent the entire door from being accidentally removed from the cabinet.

In particular, the invention comprehends the provision of such an improved mounting means in an enclosure having a cabinet defining an access opening with a pair of hinge pins disposed on the cabinet at laterally opposite sides of the access opening. The mounting means includes a pair of hub structures mounted on the door and removably associated one each with the hinge pins, each hub structure comprising means defining separable portions of a hub pivotally capturing the hinge pin when the hub portions are juxtaposed in a closed position, and permitting lateral withdrawal of the hinge pin when the hub portions are separated to an open position, and rigid movable stop means responsive to the disposition of one hub structure in an open position to positively lock the other hub structure hub portions in the closed positions.

More specifically, the hub structures in the illustrated embodiment comprise a first carrier mounted to the door for pivotal movement about a first pivot axis, a first arcuate hub portion on the first carrier spaced from the pivot axis, a second carrier mounted to the door adjacent the first carrier for pivotal movement about a second pivot axis spaced a preselected distance from the first pivot axis, a second arcuate hub portion on the second carrier spaced from the second pivot axis, the cumulative arcuate extent of the hub portions being greater than 180° for pivotally capturing an associated hinge pin in a first pivoted position of the carriers and releasing the hinge pin in a second pivoted position of the carriers, and means coupling said carriers for causing concurrent movement of each of the carriers associated with either hub structure hinge pin between the pivoted positions as a result of selective pivotal movement of the door about the opposite hinge pin.

Further more specifically, the invention comprehends the provision of such hub structures comprising a first lever mounted for pivotal movement about a first pivot axis, a first hub portion on the first lever spaced from the first pivot axis, a second lever mounted for pivotal movement about a second pivot axis spaced from the first pivot axis, a second hub portion on the second lever spaced from the second pivot axis, a slot in one of the levers, a pin on the other of the levers movably received in the slot for causing concurrent movement of the levers and means for biasing the levers concurrently to a closed position where the hub portions are juxtaposed to pivotally capture the associated hinge pin and to an open position wherein the hub portions are spaced apart to permit lateral movement of the associated hinge pins.

In the illustrated embodiment, the movable stop means comprises a rod which extends laterally between the pair of hub structures. The rod is longitudinally movable between the hub structures and has ends which selectively engage one lever of each of the respective hub portions for positively locking either hub structure in the closed position when the other hub structure is in the open position.

In the illustrated embodiment, the means for biasing the levers comprises overcenter spring-biased detent means engaging one of the levers.

In the illustrated embodiment, each hub portion comprises an arcuate wall segment upstanding on the lever, the arcuate extent of the first hub portion being substantially greater than that of the second hub portion.

Further more specifically, in the illustrated embodiment, the cumulative arcuate extent of the hub portions in the closed position is substantially greater than 180°.

The door mounting means of the present invention is extremely simple and economical of construction while yet providing the highly improved, positive door retaining function and the other features discussed above.

BRIEF DESCRIPTION OF THE DRAWINGS

Other features and advantages of the invention will be apparent from the following description taken in connection with the accompanying drawings wherein:

FIG. 1 is a fragmentary perspective view of an enclosure having door mounting means embodying the invention;

FIG. 2 is a fragmentary enlarged vertical section taken substantially along the line 2—2 of FIG. 1;

FIG. 3 is a fragmentary top plan view with portions broken away to illustrate the arrangement of the door mounting means in the closed position of the door;

FIG. 4 is a fragmentary top plan view with portions broken away illustrating an open position of the door; and FIG. 5 is a fragmentary enlarged top plan view of the left-hand hub structure in the open position.

DESCRIPTION OF THE PREFERRED EMBODIMENT

In the illustrative embodiment of the invention as disclosed in the drawing, an enclosure generally designated 10 is shown to comprise a cabinet 11 defining a front access opening 12. A closure door 13 is mounted to the cabinet at opposite sides of the access opening by upper hinge means 14 and lower hinge means 14', permitting the door to be selectively opened from either side as desired by the user. The lower hinge means is similar to the upper hinge means but installed in an inverted position relative thereto. Description of the hinge means herein is directed to the upper hinge means 14, it being understood that the lower hinge means is identical in all respects.

The upper hinge means includes a first hinge pin 15 at the left-hand side of the cabinet, and a second hinge pin 16 at the right-hand side of the cabinet. The hinge pins may be secured to the cabinet by suitable brackets 17 to depend downwardly for reception in suitable slots 18 in the top wall 19 of the closure door 13.

As shown in FIG. 1, the closure door may be provided with a left handle 20 and a right handle 21 for use in selectively opening the door from either side of the cabinet. The door mounting means further includes a pair of hub structures 22 carried at opposite sides of the door to be associated one each with the hinge pins 15 and 16, respectively. As shown in FIGS. 3 and 4, the hub structures are reversely similarly mounted at opposite sides of the door and comprise reversely identical structures. As shown in FIG. 5, hub structure 22 includes a first lever 23 mounted for pivotal movement about a first axis 24 on a pivot pin 25 mounted to a support plate 26 on door 13. A first hub portion 27 is provided on lever 23, and as shown in FIG. 5, comprises an arcuate wall segment upstanding from one end of the lever spaced from pivot axis 24.

As further shown in FIG. 5, hub structure 22 further includes a second lever 28 mounted to the support plate 26 for movement about a second pivot axis 29 spaced from first axis 24 by means of a pivot pin 30. A second hub portion 31 is provided on second lever 28 at one end thereof spaced from pivot axis 29, and as shown in FIG. 5, comprises an arcuate wall segment upstanding from the end of the lever.

As best seen in FIG. 3, the cumulative arcuate extent of hub portions 27 and 31 is substantially greater than 180° and hub structure defined by the two hub portions fits closely with the hinge pin 15, whereby the hinge pin is retained securely therein. As shown in FIG. 5, hub portion 27 may have an arcuate extent differing from that of hub portion 31, and more specifically as shown, hub portion 27 has an arcuate extent substantially less than that of hub portion 31. Illustratively, hub portion 27, as shown, has an arcuate extent less than 180° and hub portion 31 has an arcuate extent of greater than 180° for facilitating capture of the hinge pin between the arcuate hub portions 27 and 31, as illustrated in FIGS. 3 and 4.

The invention further comprehends the provision of means for causing concurrent movement of the levers 23 and 28 between a closed position, as illustrated in FIG. 3, and an open position illustrated in FIG. 5. As shown in FIG. 5, lever 23 is provided with an elongated slot 32 and lever 28 is provided a depending pin 33 slidably received in slot 32. Slot 32 extends chordally to the pin 25 and, thus, rotational movement of lever 23 about axis 24 causes a corresponding rotation of lever 28 about axis 29 of its pivot pin 30.

As further shown in FIG. 5, means generally designated 34 are provided for biasing the levers to either of the closed or opened positions. As shown, the biasing means 34 includes a detent 35 slidably received in a recess 36 in a mounting block 37 carried on support 26. The detent is biased outwardly from the recess by a coil spring 38 so as to engage the end 39 of lever 23. As shown in FIG. 5, end 39 defines a first cam surface 40 and a second cam surface 41 providing an overcenter coaction with the detent 35 so that the lever 23 will be effectively yieldably retained in either of the overcenter positions corresponding to the open and closed conditions of the hub structure. As indicated above, lever 23 is connected to the lever 28 by the pin 33 so that retention of lever 23 in either of the thrown positions correspondingly yieldably retains lever 28 in the corresponding thrown position.

As further illustrated in FIGS. 3–5, the door hinge means further includes a movable stop means generally designated 42 responsive to the disposition of one of the hub structures 22 in an open position to positively lock the other hub structure in the closed position, thereby positively retaining the door against accidental complete removal from the cabinet when opened from either side. As shown in the drawing, in the illustrated embodiment, the stop means is defined by a rigid rod 51 longitudinally slidably movable in the block 37 and a corresponding block 43 adjacent the opposite hub structure 22, as illustrated in FIG. 3. Rod 51 is biased to a centered disposition by a pair of coil springs 44 and 45 acting between a first collar 46 adjacent block 37 and a second collar 47 adjacent block 43 fixedly secured to the rod.

Rod 51 defines opposite ends 48 and 49 projecting outwardly from the blocks 37 and 43, respectively, to engage the lever 28 of the respective hub structures. In the closed disposition of the door, as shown in FIG. 3, ends 48 and 49 engage lever 28 in a recess 50, permitting the centered disposition of rod 51 with the hub structures releasably retained in the closed disposition about the hinge pins 15 and 16, respectively.

When the door is opened from either side, such as from the left side as illustrated in FIG. 4, movement of the hub structure 22 with respect to hinge pin 15 causes the hub portions 27 and 31 to move apart, against the biasing action of springs 45 and 38, to the open position of FIGS. 4 and 5. In the open position as shown, rod end 48 is engaged by a projecting nose portion 52 on the distal end of lever 28, urging the rod 51 axially toward the opposite hub structure so that, as seen in FIG. 4, end 49 of the rod is positively retained in interference with the lever 28 of the opposite hub structure 22, thereby positively preventing repositioning of the hub structure from the closed position wherein the hub portions 27 and 31 thereof effectively encircle the hinge pin 16 to prevent withdrawal of the right-hand end of the door 13 from the hinge pin and, thus, effectively positively maintaining the door in hinged association with the cabinet.

At the same time, as shown in FIG. 5, detent 35 is engaged with cam surface 40 of lever 23 of the now opened left-hand hub structure 22 to effectively maintain the levers in the overcentered, open thrown position illustrated. Thus, the hub portions 27 and 31 are maintained in the opened disposition so as to readily receive the hinge pin when the left-hand side of the door is again brought back to the closed position of FIG. 3 from the open position illustrated in FIG. 4.

In moving back to the closed position, hub portion 31 is engaged by the hinge pin so as to urge lever 28 in a counterclockwise direction, as seen in FIG. 4, about the pivot axis 29 and, as a result of the connection between the levers through pin 33, lever 23 is correspondingly pivoted in a counter-clockwise direction about its pivot axis 24 to bring the partial hub portions 27 and 31 back to the hinge pin encircling relationship illustrated in FIG. 3 of the closed condition of the hub structures.

In the illustrated embodiment, the levers 23 and 28 effectively define carriers for the arcuate hub portions 27 and 31, respectively. Thus, the elements 23 and 28 may have, within the broad scope of the invention, other configurations, including the illustrated elongated lever configuration. Similarly within the scope of the invention, other suitable overcenter retaining means and rod biasing means may be employed, as will be obvious to those skilled in the art. As indicated above, each of the hub structures is similar and functions in a manner similar to that described above relative to the upper left hub structure 22. As shown in FIG. 1, the door mounting means may be effectively mounted within the upper portion and lower portion of the door 13 and carried on support plates 26.

Because of the positive, close-fitting retention of the hinge pins by then associated hub structure, the door mounting means of the present invention is advantageously adapted for use with relatively large or heavy refrigerator doors which may carry substantial amounts of food and the like on the door shelves.

The foregoing disclosure of specific embodiments is illustrative of the broad inventive concepts comprehended by the invention.

Having described the invention, the embodiments of the invention in which an exclusive property or privilege is claimed are defined as follows:

1. In an enclosure having a cabinet defining an access opening with a pair of hinge pins disposed on the cabinet at laterally opposite sides of the opening, and a closure door for selectively closing the opening, improved means for mounting the door to the opposite hinge pins for selective opening of the door from either side of the opening, said mounting means comprising:

a pair of hub structures on the door removably associated one each with said hinge pings, each said hub structure comprising a first lever mounted for pivotal movement about a first pivot axis, a first hub portion on said first lever spaced from said first pivot axis, a second lever mounted for pivotal movement about a second pivot axis spaced from said first pivot axis, a second hub portion on said second lever spaced from said second pivot axis, said hub portions being configured complementarily to said hinge pins, a slot in one of said levers, a pin on the other of said levers movably received in said slot for causing concurrent movement of said levers, and means for biasing said levers concurrently to a closed position where said hub portions are juxtaposed to fit about and pivotally capture an associated hinge pin and to an open position wherein said hub portions are spaced apart to permit lateral withdrawal of the associated hinge pin; and a rod longitudinally movable between said hub structures and having ends selectively engaging one lever of each of the respective hub structures for positively locking either hub structure in the closed position when the other hub structure is in the open position, wherein said means for biasing the levers comprising spring-biased detent means engaging one of said levers and said one of said levers including first and second cam surfaces which cooperate with said detent means to provide overcenter movement of said one of said levers between said open and closed positions.

2. The enclosure door mounting structure of claim 1 wherein means are provided for biasing said rod to a centered position with each of said hub structures in the closed position.

3. The enclosure door mounting structure of claim 1, wherein said hub portions are arcuate, the cumulative arcuate extent of said first and second arcuate hub portions being greater than 180°.

4. The enclosure door mounting structure of claim 1 wherein the cumulative arcuate extent of the hub portions in said closed position of the levers is greater than 270°.

5. The enclosure door mounting structure of claim 1 wherein the arcuate extent of one of said hub portions is greater than 180°.

6. The enclosure door mounting structure of claim 1, including means for resiliently centering the rod between said hub structures when the levers of each hub structure are in said closed position.

7. The enclosure door mounting structure of claim 1 wherein each of said hub portions comprises an arcuate wall segment.

8. The enclosure door mounting structure of claim 1 wherein each of said hub portions comprises an arcuate wall segment, the arcuate extent of said first hub portion being substantially less than that of the second hub portion.

9. The enclosure door mounting structure of claim 1 wherein each of said hub portions comprises an arcuate wall segment, the arcuate extent of said first hub portion being substantially less than that of the second hub portion, and the cumulative arcuate extent of said hub portions in the closed position being substantially greater than 180°.

* * * * *